US010981292B2

(12) United States Patent
Schlecker et al.

(10) Patent No.: US 10,981,292 B2
(45) Date of Patent: Apr. 20, 2021

(54) HANDHELD WORK APPARATUS

(71) Applicant: Andreas Stihl AG & Co. KG, Waiblingen (DE)

(72) Inventors: Christian Schlecker, Waiblingen-Neustadt (DE); Juergen Haeberlein, Sulzbach an der Murr (DE); Andreas Garstenauer, Chesapeake, VA (US); Eric Wawrzkiewicz, Virginia Beach, VA (US); Andreas Giesea, Ojai, CA (US)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/530,681

(22) Filed: Aug. 2, 2019

(65) Prior Publication Data

US 2020/0039104 A1 Feb. 6, 2020

(30) Foreign Application Priority Data

Aug. 3, 2018 (EP) ..... 18187375

(51) Int. Cl.
*B27B 17/12* (2006.01)
*B27B 17/08* (2006.01)

(52) U.S. Cl.
CPC ..... *B27B 17/12* (2013.01); *B27B 17/08* (2013.01)

(58) Field of Classification Search
CPC ..... B27B 17/12; B27B 17/08
See application file for complete search history.

(56) References Cited

U.S. PATENT DOCUMENTS

| | | | | |
|---|---|---|---|---|
| 4,830,212 | A | 5/1989 | Nagashima et al. | |
| 9,381,665 | B2 * | 7/2016 | Onose | B23D 57/023 |
| 2008/0087080 | A1 | 4/2008 | Gwosdz et al. | |
| 2015/0047210 | A1 | 2/2015 | Watanabe et al. | |
| 2015/0321377 | A1 | 11/2015 | Onose et al. | |
| 2020/0049113 | A1 * | 2/2020 | Okada | B27B 17/00 |

FOREIGN PATENT DOCUMENTS

| | | | |
|---|---|---|---|
| CN | 205291191 | U | 6/2016 |
| DE | 3803745 | A1 | 8/1988 |
| DE | 102006048550 | A1 | 4/2008 |
| DE | 202007017548 | U1 | 5/2008 |
| DE | 202014102311 | U1 | 6/2014 |
| EP | 0922161 | B1 | 6/1999 |
| JP | 2004293448 | A | 10/2004 |
| JP | 2014109200 | A | 6/2014 |
| WO | 2013121768 | A1 | 8/2013 |

* cited by examiner

*Primary Examiner* — Omar Flores Sanchez
(74) *Attorney, Agent, or Firm* — Walter Ottesen, P.A.

(57) ABSTRACT

A handheld work apparatus includes a drive motor, an operating-fluid tank and a motor carrier on which the drive motor is held. The operating-fluid tank has a first housing section and a second housing section. The first housing section is realized so as to be integral with the motor carrier. At least a portion of the second housing section is formed from light-transmitting material to permit discerning the fill level of the operating-fluid tank. The motor carrier has a light-transmitting light conductive element for conducting light into the operating-fluid tank.

18 Claims, 10 Drawing Sheets

HANDHELD WORK APPARATUS

CROSS REFERENCE TO RELATED APPLICATION

This application claims priority of European patent application no. 18 187 375.3, filed Aug. 3, 2018, the entire content of which is incorporated herein by reference.

FIELD OF THE INVENTION

The invention is directed to a handheld work apparatus having a drive motor, an operating-fluid tank, and a motor carrier whereon the drive motor is held. The operating-fluid tank has a first housing section and a second housing section. The first housing section is integral with the motor carrier and a portion of the second housing section is formed from light-transmitting material for the purpose of discerning the fill level of the operating-fluid tank.

BACKGROUND OF THE INVENTION

In the case of handheld work apparatuses having an operating-fluid tank that is realized so as to be integral with the motor carrier and that may contain, for example, lubricating oil for lubricating a component of the work apparatus, or fuel for driving an internal combustion engine, it is desirable that the fill level of the operating-fluid be easily discernible.

Known from US 2008/0087080 A1 is an operating-fluid tank of a handheld work apparatus having a viewing window integrated into a cap part—or having a second housing section—of the operating-fluid tank.

It is also known, for the purpose of discerning the fill level of the operating-fluid tank, to realize the second housing section of the operating-fluid tank entirely from light-transmitting material.

Despite the light-transmitting material of the second housing section comprising the filling opening, the fill level of the operating-fluid tank is only discernible with difficulty.

SUMMARY OF THE INVENTION

It is an object of the invention to provide a work apparatus of the type described above which is improved in such a manner that the fill level of the operating-fluid tank is rendered clearly discernible.

The object is achieved by a handheld work apparatus including: a drive motor; a motor carrier for accommodating and holding the drive motor thereon; an operating-fluid tank having a first housing section and a second housing section; the first housing section being integrally formed with the motor carrier so as to be a unitary part therewith; the second housing section having a portion thereof made of light-transmitting material to permit discerning the fill level of the operating-fluid tank; and, the motor carrier including a light-transmitting light-conducting element for conducting light into the operating-fluid tank.

The invention provides that the motor carrier has a light-transmitting light conductive element for conducting light into the operating-fluid tank. Owing to the light conductive element, more light gets into the operating-fluid tank. The light-transmitting light conductive element can absorb light and conduct it into the operating-fluid tank. The light conductive element need not be an optical conductor in the physical sense, in which light is transported by means of reflection, over short or long distances, to the boundary surfaces of the optical conductor. Instead, in the case of the light conductive element according to the invention, it is sufficient for it to be composed of a light-transmitting material, on which visible light is scattered. The light that is incident upon the light conductive element can be transmitted by the light-transmitting light conductive element into the operating-fluid tank. The incident light shines into the operating-fluid tank through the light conductive element. In addition, by means of scattering in the light conductive element, the light that is incident upon the light conductive element can be conducted into the operating-fluid tank by the light conductive element also from parts of the motor carrier that are remote from the operating-fluid tank. The light conductive element collects light and guides it into the operating-fluid tank. The light conductive element can therefore also be referred to as a light collecting element.

As a result of light being conducted, via the light conductive element, into the operating-fluid tank, the fill level of the operating-fluid tank is clearly discernible through the second housing section of the operating-fluid tank that is formed, at least partly, from light-transmitting material.

Advantageously, the light conductive element is arranged in such a manner that it conducts light into the first housing section of the operating-fluid tank. As a result, a kind of background illumination can be produced, which enables the fill level to be clearly discernible through the second housing section.

The first housing section of the operating-fluid tank may be covered, at least partly, by an opaque element of the work apparatus. In this case, it may be particularly advantageous for light to be conducted into the operating-fluid tank, in particular into the first housing section, by the light conductive element. Light can be conducted, through the light conductive element, via locations of the first housing section of the operating-fluid tank that are covered by the opaque element.

Advantageously, the entire second housing section of the operating-fluid tank is formed from light-transmitting material. This makes it easier to discern the fill level of the operating-fluid tank, through the second housing section.

Expediently, the light conductive element is translucent. The light conductive element is thus only partially light-transmitting. It can then efficiently scatter light and, at the same time, transmit a portion of the light. In this way, the light conductive element can advantageously fulfill both of its functions, of collecting light and conducting light. The translucent light conductive element is light-transmitting, but not view-transparent or image-transparent. Advantageously, the light conductive element transmits with a measurement of less than 50% of the visible light, according to the standard ISO 2471. In particular, the light conductive element transmits with a measurement of more than 20% of the visible light, according to the standard ISO 2471.

In an advantageous embodiment of the invention, the light conductive element is composed of plastic. The light conductive element can thus be produced in a simple and inexpensive manner. Owing to the use of plastic, even complex shapes of the light conductive element are easily realized.

Expediently, the light conductive element is composed of fiber-reinforced plastic. Advantageously, the plastic comprises between 30% by weight and 40% by weight, in particular between 33% and 37%, fibers. Preferably, the fibers are glass fibers. As a result, the light conductive element can have a high degree of translucence, that is, a high transmission rate for visible light with, at the same time, sufficient strength.

Expediently, less than 0.1% by weight color pigments are admixed with the plastic. As a result, a high degree of light transmittance can be achieved.

In an advantageous embodiment of the invention, the light conductive element is part of an exterior wall of the motor carrier. As a result, the light conductive element can easily be realized so as to be integral with the motor carrier. This reduces the number of components of the work apparatus, and result in easy assembly of the work apparatus. As a result of the light conductive element being integrated into the exterior wall of the motor carrier, the light conductive element can be realized in such a manner that it does not project over the motor carrier.

Expediently, the light conductive element extends at least over a portion of the wall thickness of the exterior wall of the motor carrier. Advantageously, the light conductive element extends over the entire wall thickness of the exterior wall of the motor carrier. As a result, the entire wall thickness of the motor carrier, in the region of the light conductive element, can be used for collecting light and conducting it into the operating-fluid tank.

In an advantageous embodiment of the invention, the light conductive element extends over at least 5%, in particular over at least 20%, of an outer surface of the motor carrier. As a result, light can be conducted into the operating-fluid tank over the surface of the motor carrier.

Advantageously, the light conductive element comprises the entire first housing section of the operating-fluid tank. As a result, light can be conducted particularly effectively into the first housing section of the operating-fluid tank. This makes it possible to create a kind of background illumination of the second housing section, which is particularly efficient, since the light conductive element comprises the entire first housing section. As a result, the fill level can be discerned particularly clearly through the second housing section.

In an advantageous embodiment of the invention, the light conductive element comprises the entire motor carrier. As a result, a large quantity of light can easily be conducted into the operating-fluid tank.

Expediently, the operating-fluid tank is an oil tank. It may also be provided that the operating-fluid tank is a fuel tank.

The work apparatus may be a power chainsaw, and comprise both the oil tank and the fuel tank. Advantageously, the light conductive element of the oil tank and the light conductive element of the fuel tank may be formed by a common component.

Advantageously, the motor carrier carries a tool.

Expediently, the motor carrier is realized so as to be translucent, both in a region distant from the operating-fluid tank and in a region adjoining the operating-fluid tank.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
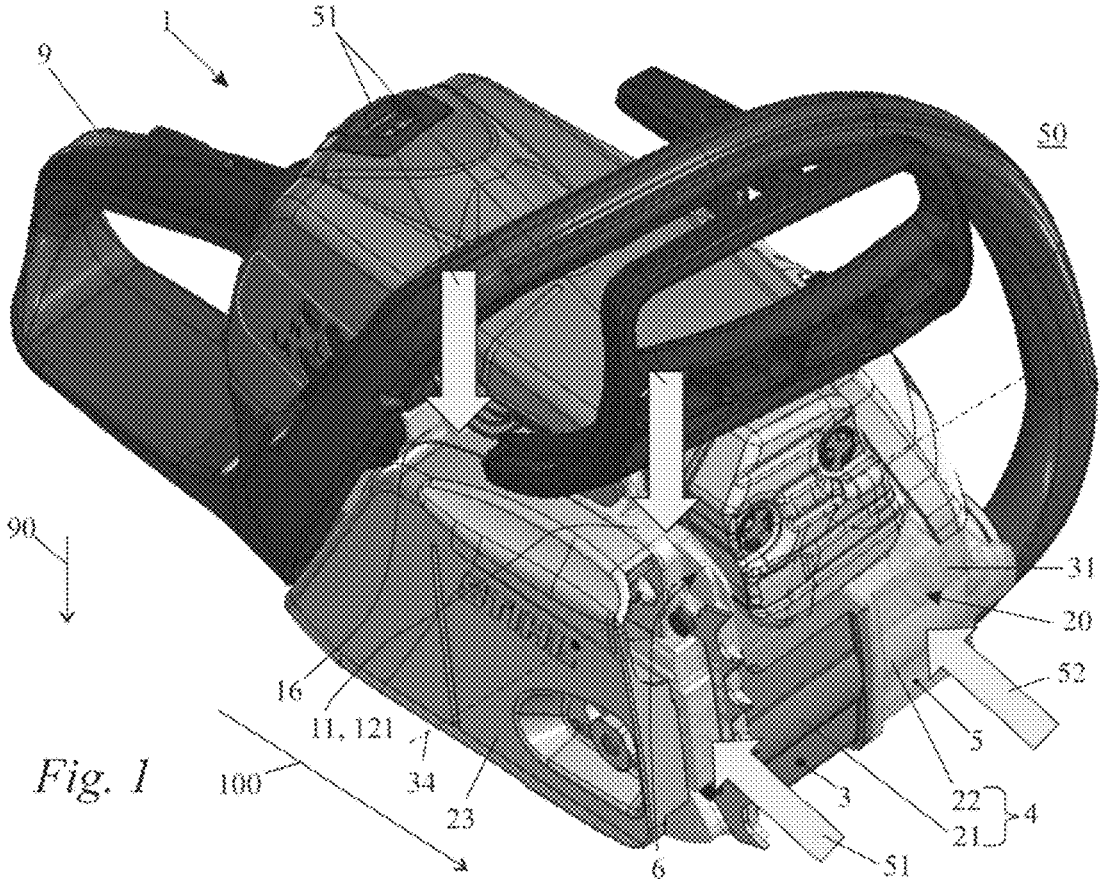
FIG. 1 is a schematic perspective view of a handheld work apparatus according to the invention.

FIG. 1, in a schematic perspective view, shows a handheld work apparatus 1 having an operating-fluid tank 4. The handheld work apparatus 1 comprises a drive motor 2, represented in FIG. 9. The drive motor 2 is held on a motor carrier 3. In the embodiments, the drive motor 2 is an internal combustion engine. It may also be provided, however, that the drive motor is an electric motor. As represented in FIG. 1, the operating-fluid tank 4 has a first housing section 21 and a second housing section 22. The first housing section 21 is realized so as to be integral with the motor carrier 3. The realization of the first housing section 21 so as to be integral with the motor carrier 3 is achieved, in particular, by producing the motor carrier 3, including the first housing section 21, in a casting process, advantageously in an injection molding process. The second housing section 22 is realized so as to be integral with the cover molded part 31. The motor carrier 3 is made of plastic. The cover molded part 31 is made of plastic. In the embodiment, the work apparatus 1 is a power chainsaw. However, the handheld work apparatus may also be any other handheld work apparatus having an operating-fluid tank, in which the first housing section is realized so as to be integral with the motor carrier.

The operating-fluid tank 4 contains operating fluid 5. The operating fluid may be, for example, oil or fuel for an internal combustion engine. The operating-fluid tank 4 according to FIG. 1 contains oil as an operating fluid 5. For the purpose of discerning the fill level of the operating-fluid tank 4, in the embodiments the entire second housing section 22 is formed from light-transmitting material. In the embodiments, the entire second housing section 22 of the operating-fluid tank 4 is formed from translucent material. The translucent material is only partially light-transmitting. It lets some light through, but is not transparent. In the embodiments, more than 20% of the visible light is transmitted by the translucent material. Less than 50% of the visible light is transmitted by the translucent material. The transmission values are measured according to the standard ISO 2471. Between 50% and 80% of the visible light is absorbed in the translucent material. Light passes from the outside 50 of the work apparatus 1 into an interior 20 of the operating-fluid tank 4 through the translucent material of the second housing section 22. This is represented in FIG. 1 by the arrow 52. On the outside of the second housing section 22, the fill level of the operating-fluid tank 4 can be discerned because of the contrast between the region of the operating-fluid tank 4 with operating fluid 5 and the region of the operating-fluid tank 4 without operating fluids. It is thus easy to ascertain how much operating fluid 5 is still present in the operating-fluid tank 4.

The first housing section 21 of the operating-fluid tank 4 is covered, at least partly, by an opaque element 23 of the work apparatus 1. In the embodiment, the opaque element 23 is a sprocket-wheel cover. However, the opaque element of the work apparatus may also be, for example, a paint layer. In the case of work apparatuses according to the prior art, owing to such opaque elements, insufficient light enters the operating-fluid tank to permit easy discernment of the fill level of the operating-fluid tank in the second housing section of the operating-fluid tank.

In order to bring more light into the interior 20 of the operating-fluid tank 4, in particular into the interior of the first housing section 21 of the operating-fluid tank 4, the motor carrier 3 has a light-transmitting first light conductive element 11 for conducting light into the operating-fluid tank 4.

The first light conductive element 11 is characterized in that it collects light exclusively at a location or locations lying remote from the first housing section 21 of the operating-fluid tank 4. The absorption of light into the first light conductive element 11 is effected in a region of an exterior wall 6 of the motor carrier 3 that does not delimit the volume of the operating-fluid tank 4. Unlike a second light conductive element 111 that is represented in FIGS. 3 to 19, the first light conductive element 11 does not collect light directly on the first housing section 21 of the operating-fluid tank 4.

The first light conductive element 11 extends, in the longitudinal direction 100 of the work apparatus 1, transversely in relation to an axis of rotation 34 of the drive motor 2, which is concealed in FIG. 1, in the direction from a handle 9 to the operating-fluid tank 4. The first light conductive element 11 according to FIG. 1 runs in an offset manner in a plane perpendicular to the axis of rotation 34. The first light conductive element 11 has an end 16 that faces toward the handle 9 of the work apparatus 1. Starting from the end 16 of the first light conductive element 11, the first light conductive element 11 first runs, in the longitudinal direction 100, in the direction away from the handle 9, and then angles downward in the vertical direction 90. The first light conductive element 11 extends as far as the interior 20 of the operating-fluid tank 4. The first light conductive element 11 conducts light as far as the interior 20 of the operating-fluid tank 4. In the embodiment according to FIG. 1, the first light conductive element 11 is connected to a concealed rear wall of the first housing section 21 of the operating-fluid tank 4, at a light entry point of the first housing section 21 that is likewise not represented. At least a portion of the light absorbed by the first light conductive element 11 is conducted, at the light entry point, into the operating-fluid tank 4. When the handheld work apparatus 1 is in a non-operating position, the light entry point is located in an upper region of the operating-fluid tank 4. When the operating-fluid tank 4 is not completely full, the light inlet point is located above the operating fluid 5 when the handheld work apparatus 1 is in the non-operating position. As a result, the light is conducted from the first light conductive element 11, through the light inlet point, into a region of the operating-fluid tank 4 in which there is no operating fluid 5.

The motor carrier 3 comprises the exterior wall 6. The first light conductive element 11 is part of the exterior wall 6. The first light conductive element 11 extends at least over a portion of the wall thickness of the exterior wall. The entire first light conductive element 11 is translucent. When visible light is incident upon the light conductive element, more than 30% of the incident light is transmitted. Upon the incidence of visible light, less than 50% of the incident light is transmitted by the first light conductive element 11. As a result, a large quantity of the incident light is scattered in the first light conductive element 11 and is conducted, inside the first light conductive element 11, by means of subsequent scattering processes. In FIG. 1, the visible light that is incident upon the first light conductive element 11 is represented by arrows 51.

As represented in FIG. 1, the light is incident upon the first light conductive element 11, along the arrows 51, at a location remote from the operating-fluid tank 4, and from there is conducted by scattering to the operating-fluid tank 4. In the embodiment according to FIG. 1, the light collected in such a manner by the first light conductive element 11 at the rear wall of the first housing section 21 of the operating-fluid tank 4 enters the interior 20 of the operating-fluid tank 4 at the light inlet point. As a result, a kind of background illumination is produced. This background illumination illuminates the interior of the second housing section 22 of the operating-fluid tank 4, starting from the rear wall of the first housing section 21 that faces away from the second housing section 22. As a result, the contrast between regions of the second housing section 22 in which operating fluid 5 is present, and regions of the operating-fluid tank 4 in which no operating fluid 5 is present, is increased. As a result, the fill level of the operating-fluid tank 4 is clearly discernible from the outside 50 of the work apparatus 1, on the second housing section 22 of the operating-fluid tank 4.

Figure 2:
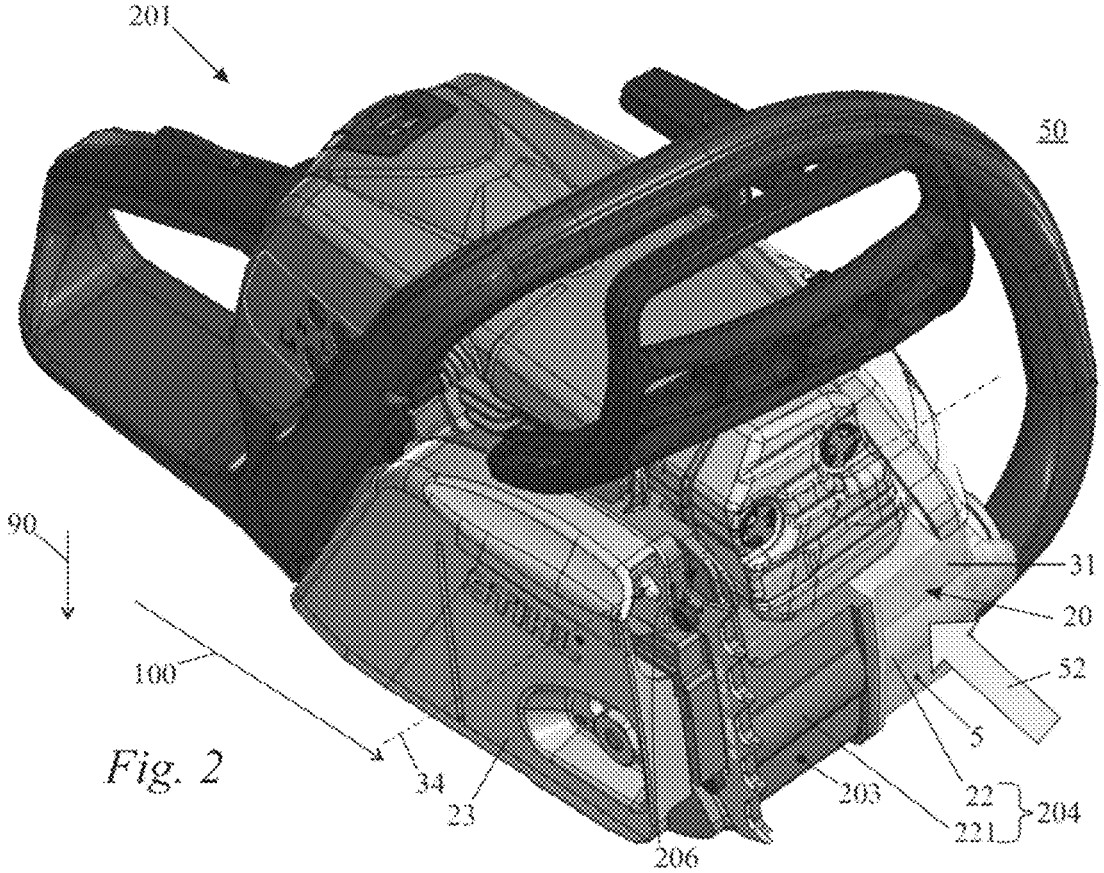
FIG. 2 is a schematic perspective view of a handheld work apparatus according to the prior art.

For comparison of the handheld work apparatus 1 according to the invention, represented in FIG. 1, with the prior art, a handheld work apparatus 201 according to the prior art is shown in FIG. 2. Components of the handheld work apparatus 201 according to the prior art that are identical to components of the handheld work apparatus 1 according to the invention are denoted by the same references. Unlike the handheld work apparatus 1 according to the invention, the handheld work apparatus according to the prior art does not have a translucent first light conductive element 11 that is part of the exterior wall 6 of the motor carrier 3. The handheld work apparatus 201 according to the prior art instead comprises a motor carrier 203. The exterior wall of the motor carrier 203 is opaque, and does not have a translucent light conductive element at any point. An operating-fluid tank 204 of the handheld work apparatus 201 comprises a first housing section 221 and the second housing section 22. The first housing section 221 is part of the motor carrier 203. The first housing section 221 does not have any light entry point into the operating-fluid tank 204. As represented by the arrow 52 in FIG. 2, light can only enter the operating-fluid tank 204 through the second, translucent, housing section 22.

Figure 3:
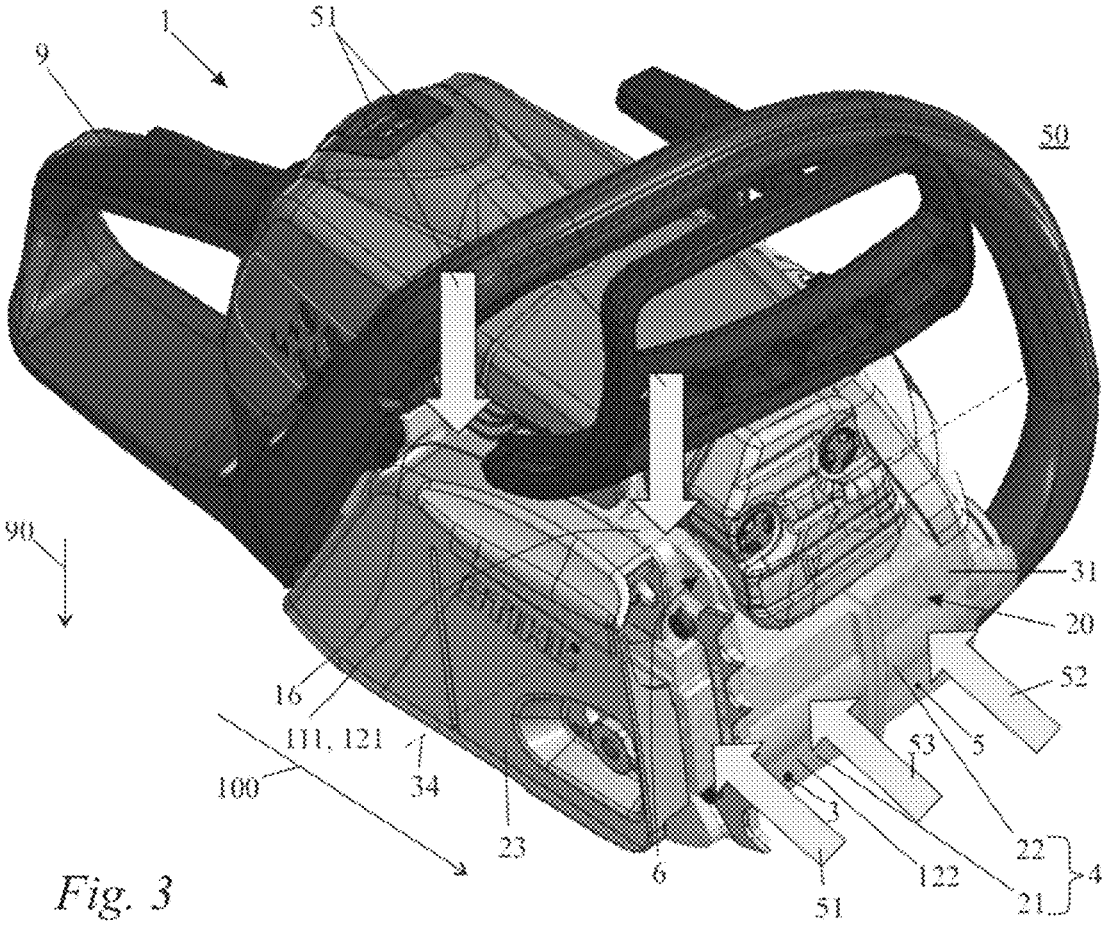
FIGS. 3 to 5 are schematic perspective views of an alternative embodiment of a handheld work apparatus according to the invention.
Figure 4:
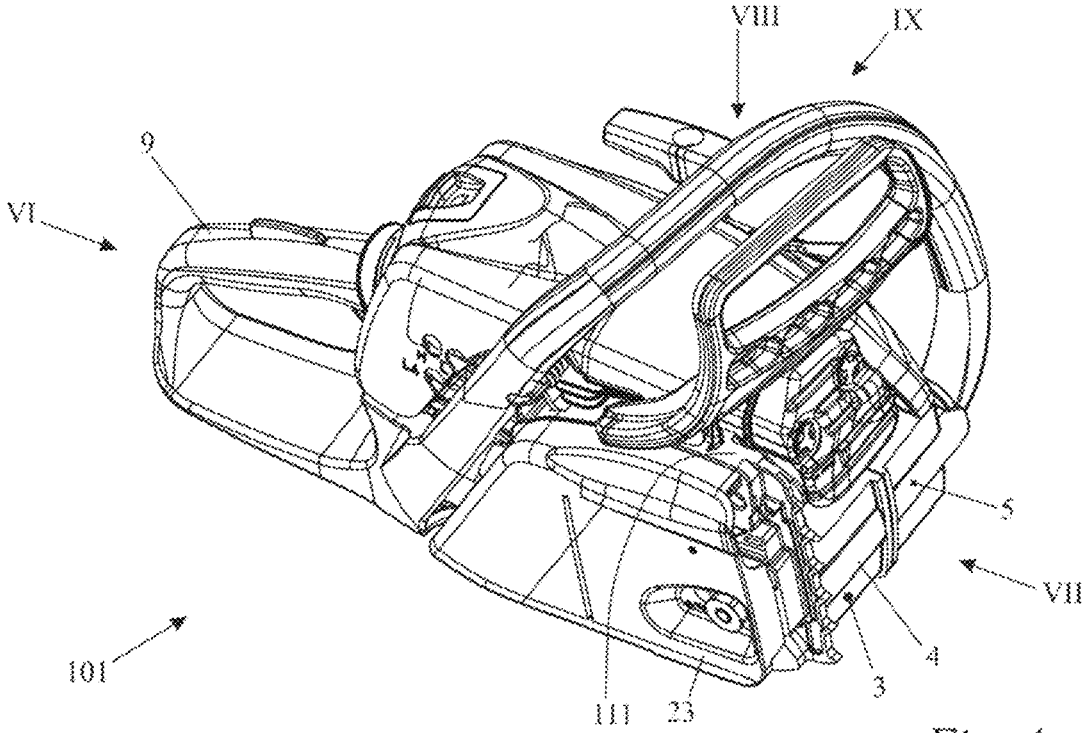

FIGS. 3 to 19 relate to an alternative embodiment of a work apparatus 101 according to FIG. 1. Components of the work apparatuses 1 and 101 that correspond are denoted by the same references. Only the references relating to the light conductive elements differ. The statements relating to the rest of the components of the work apparatus 1 and 101, but not relating to the light conductive elements, are also applicable to the respectively other work apparatus. As represented in FIGS. 5 to 10, the work apparatus 101 also comprises the first operating-fluid tank 4. The first operating-fluid tank 4 contains, as a first operating fluid 5, oil for lubricating a saw chain, not shown (FIG. 4). It may be provided that the work apparatus 1 and the work apparatus 101 also comprise a second operating-fluid tank 14, represented in FIG. 6. The second operating-fluid tank 14 contains, as a second operating fluid 15 (FIG. 6), fuel for operating the drive motor 2, realized as an internal combustion motor, represented in FIG. 9.

Figure 5:
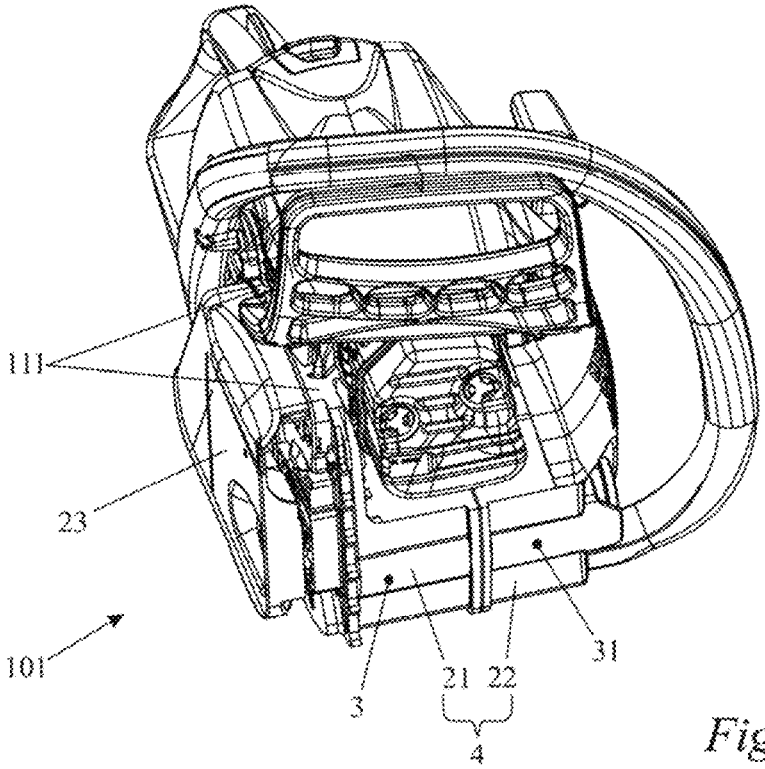
Figure 6:
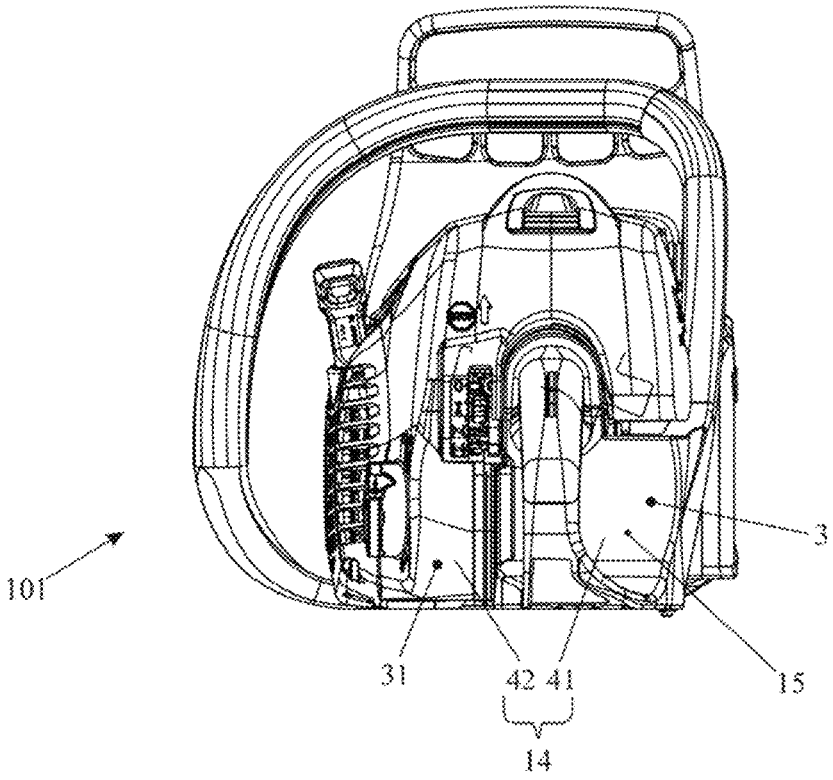
FIG. 6 is a schematic side view of the work apparatus from FIG. 4, perpendicular to the axis of rotation of the drive motor, toward a rear handle, in the direction of the arrow VI in FIG. 4.

As can be seen from FIGS. 4 and 5, the work apparatus 101 comprises a second light conductive element 111.

Unlike the first light conductive element 11 according to FIG. 1, the second light conductive element 111 of the handheld work apparatus 101 according to FIGS. 3 to 19 also extends over the first housing section 21 of the operating-fluid tank 4. The second light conductive element 111 of the work apparatus 101 according to FIGS. 3 to 19 collects light, both in the region of the exterior wall 6 of the motor carrier 3 that is remote from the first housing section 21 of the operating-fluid tank 4 and/or of the operating-fluid tank 14, and in the region of the exterior wall 6 of the motor carrier 3 that delimits the operating-fluid tank 4. The second light conductive element 111 is produced from the same material as the first light conductive element 11 of the work apparatus 1. All statements relating to the first light conductive element 11 of the handheld work apparatus 1 according to FIG. 1 also apply to the second light conductive element 111 of the handheld work apparatus 101 according to FIGS. 3 to 19.

The light conductive element 11, 111 is part of the motor carrier 3. The motor carrier 3 is a supporting component of the handheld work apparatus 101. The motor carrier 3 carries the drive motor 2. The drive motor 2 is fastened to the motor carrier 3. A guide bar, not represented, is also directly fastened to the motor carrier 3. The motor carrier 3 carries a tool. The tool is a saw chain. The saw chain is guided in the guide bar. The motor carrier 3 takes up the forces acting upon the saw chain and upon the guide bar.

The second housing section 22 of the first operating-fluid tank 4 is formed entirely from light-transmitting material. The light-transmitting material is the translucent material already described in connection with the first embodiment, and for visible light has the transmission values of between 20% and 50%, measured according to the standard ISO 2471 described there. This enables the fill level of the first operating-fluid tank 4 to be discerned. As represented in FIG. 3 by the arrow 53, light can pass, through the first housing section 21 of the operating-fluid tank 4, into the inside 20 of the operating-fluid tank 4 represented in FIGS. 17 and 18.

The second light conductive element 111 of the handheld work apparatus 101 can be divided into a first translucent element 121 and a second translucent element 122. The first translucent element 121 is arranged at a distance from the operating-fluid tank 4, 14 and extends as far as the operating-fluid tank 4, 14. The first translucent element 121 is part of the motor carrier 3. The motor carrier 3 is translucent in the region of the first translucent element 121. The first light conductive element 11 represented in FIG. 1 likewise comprises the first translucent element 121, arranged at a distance from the operating-fluid tank 4.

The second translucent element 122 is part of the first housing section 21 of the operating-fluid tank 4. The first housing section 21 of the operating-fluid tank 4 has an exterior wall 26, represented in FIG. 17. The exterior wall 26 separates the interior 20 of the first operating-fluid tank 4 from the outside 50 of the handheld work apparatus 101. The second translucent element 122 is part of the exterior wall 26 of the first housing section 21 of the operating-fluid tank 4. In the region of the second translucent element 122 the exterior wall 26 of the first housing section 21 of the operating-fluid tank 4 is translucent. In the embodiment according to FIGS. 3 to 19, the entire exterior wall 26 of the first housing section 21 of the operating-fluid tank 4 is translucent. Likewise, in the embodiment according to FIGS. 3 to 19, the motor carrier 3 is realized so as to be translucent in a region adjoining the operating-fluid tank 4. The first light conductive element 11 represented in FIG. 1 does not have a second translucent element realized as part of the first housing section 21 of the operating-fluid tank 4.

FIGS. 10 to 19 show various views of the motor carrier 3 and of the cover molded part 31. Together the motor carrier 3 and the cover molded part 31 form a central part of the work apparatus 101. The central part of the work apparatus 101 is arranged between the guide bar, not represented, and the handle 9 of the work apparatus 101, which is represented in FIG. 4. When the work apparatus 101 is in the assembled state, the cover molded part 31 is arranged on the motor carrier 3. The cover molded part 31 and the motor carrier 3 are next to each other in the direction of the axis of rotation 34. The cover molded part 31 and the motor carrier 3 are fixedly connected to each other. In the work apparatus 101 according to FIG. 4, the drive motor 2, realized as an internal combustion engine, is mounted on the motor carrier 3 represented in FIG. 10. The first housing section 21 of the first operating-fluid tank 4 and the first housing section 41 of the second operating-fluid tank 14 are realized so as to be integral with the motor carrier 3. The drive motor 2 is arranged, in the longitudinal direction 100, between the first housing section 21 of the first operating-fluid tank 4, or of the motor carrier 3, and the first housing section 41 of the second operating-fluid tank 14, or of the motor carrier 3.

Figure 10:
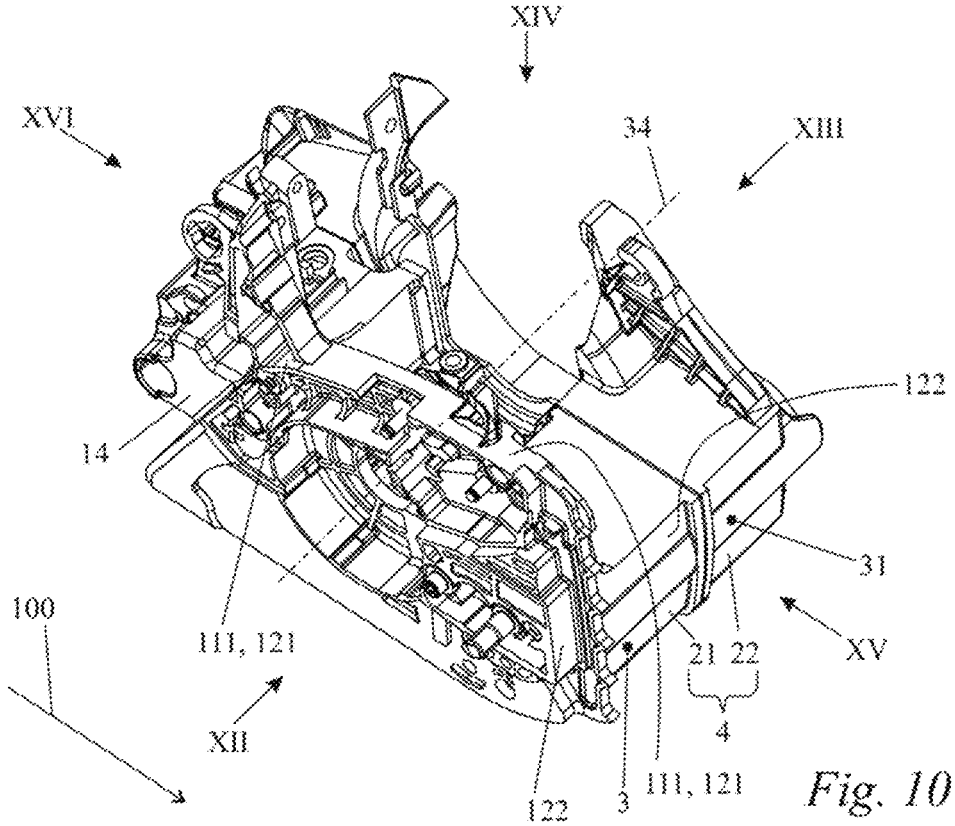
FIGS. 10 and 11 are schematic perspective views of a motor carrier, and of the cover molded part mounted thereon, of the handheld work apparatus from FIG. 4.
Figure 11:
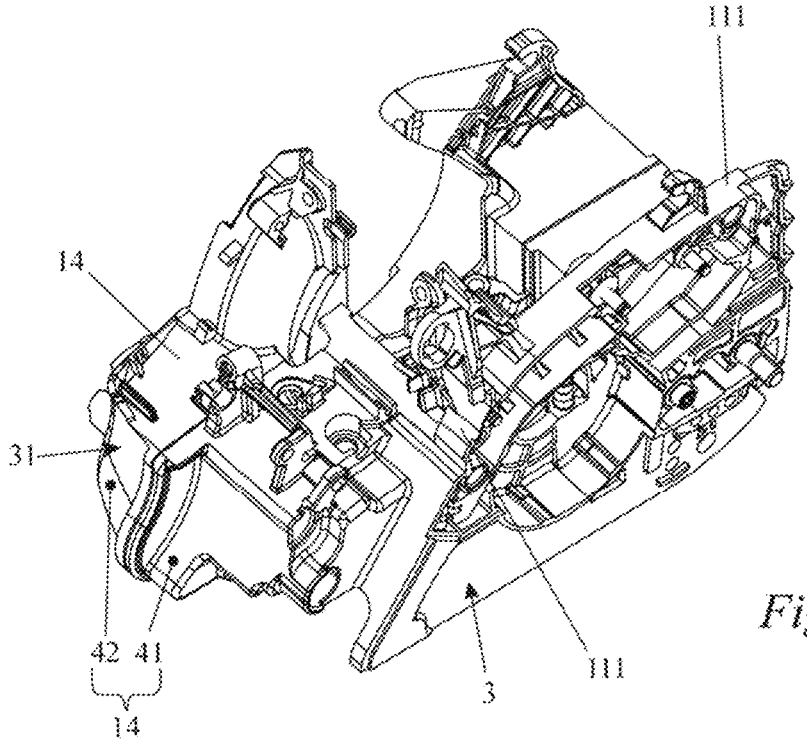

Arrows XII, XIII, XIV, XV and XVI are shown in the schematic perspective representation of the central part according to FIG. 10. The arrows each indicate a direction of view, from which the central part is viewed in FIGS. 12 to 16. In this case, the arrows are each respectively assignable to the figures whose Arabic numeral corresponds to the Roman numeral of the arrows.

FIG. 11 again illustrates the position of the second light conductive element 111. The second light conductive element 111 is connected to the second operating-fluid tank 14. The second operating-fluid tank 14 has a first housing section 41 and a second housing section 42. The first housing section 41 is realized so as to be integral with the motor carrier 3. The second housing section 42 is realized so as to be integral with the cover molded part 31.

Figure 12:
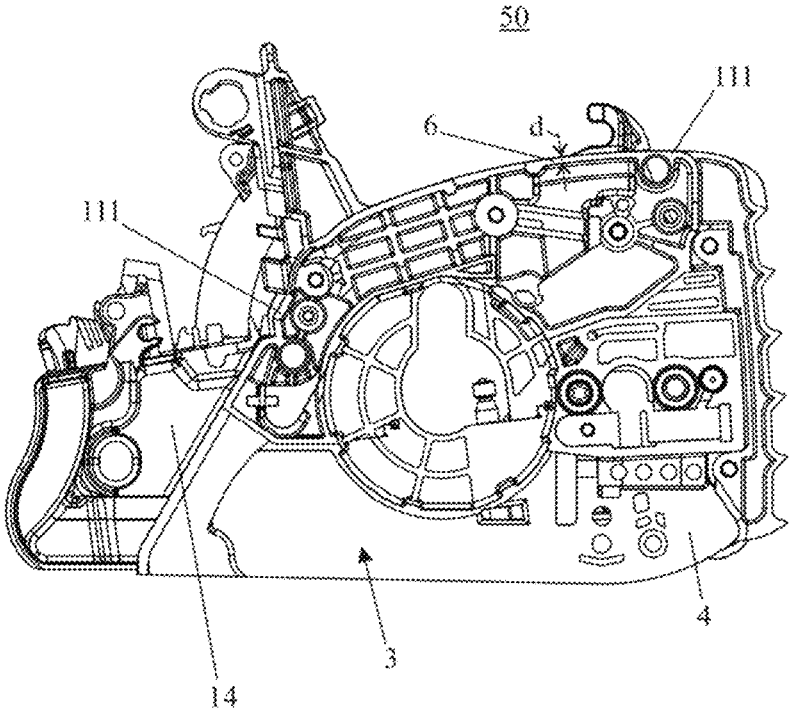
FIGS. 12 to 16 are schematic side views of the motor carrier and of the cover molded part from FIGS. 10 and 11; and, FIGS. 17 to 19 are schematic perspective views of the motor carrier, and of the cover molded part, represented when removed from the motor carrier, from FIGS. 10 and 11.
Figure 17:
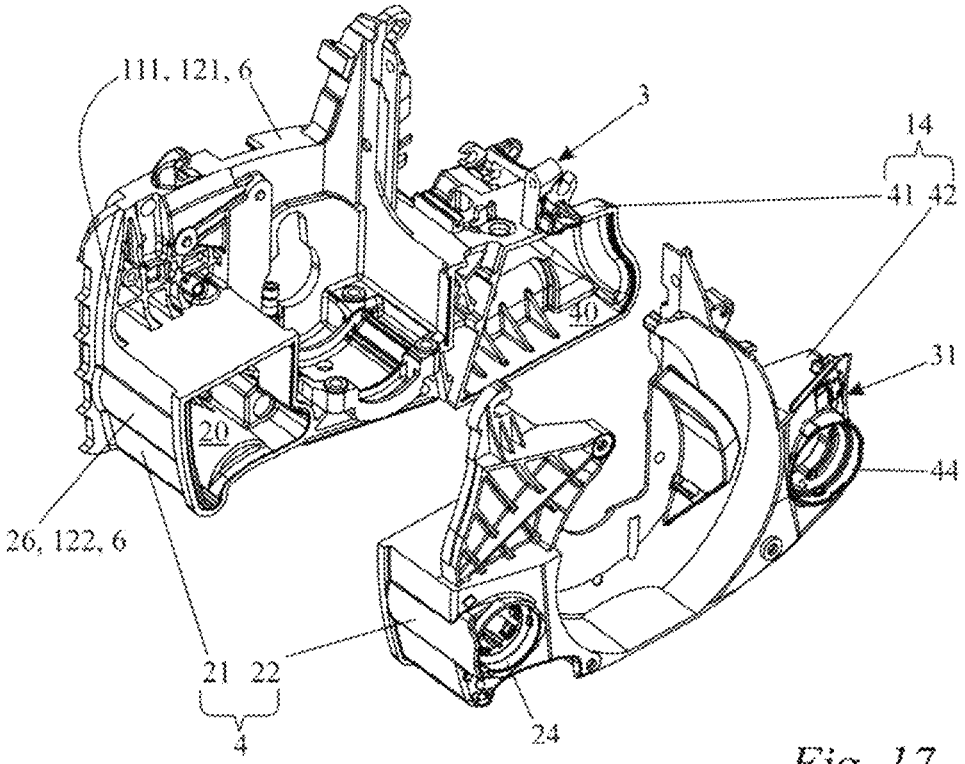

As represented in FIG. 12, the motor carrier 3 has an exterior wall 6 that has a varying wall thickness d. The exterior wall 6 is at least partly visible, in particular in the region of the second light conductive element 111, from the outside 50 of the work apparatus 101. The second light conductive element 111 extends, at least in sections, over the entire wall thickness d of the exterior wall 6. As a result, light can shine through the exterior wall 6, through the region of the exterior wall 6 in which the second light conductive element 111 is arranged and in which the second light conductive element 111 extends over the entire wall thickness d of the exterior wall 6. Advantageously, in the region referred to, the second light conductive element 111 is, at least partly, not covered by other components of the handheld work apparatus 101. The second light conductive element 111 is located, at least partly visible from the outside 50 of the handheld work apparatus 101, on the surface of the handheld work apparatus 101. The exterior wall 6 of the motor carrier 3 partly delimits the interior 20 of the operating-fluid tank 4 that is represented in FIG. 17.

Figure 7:
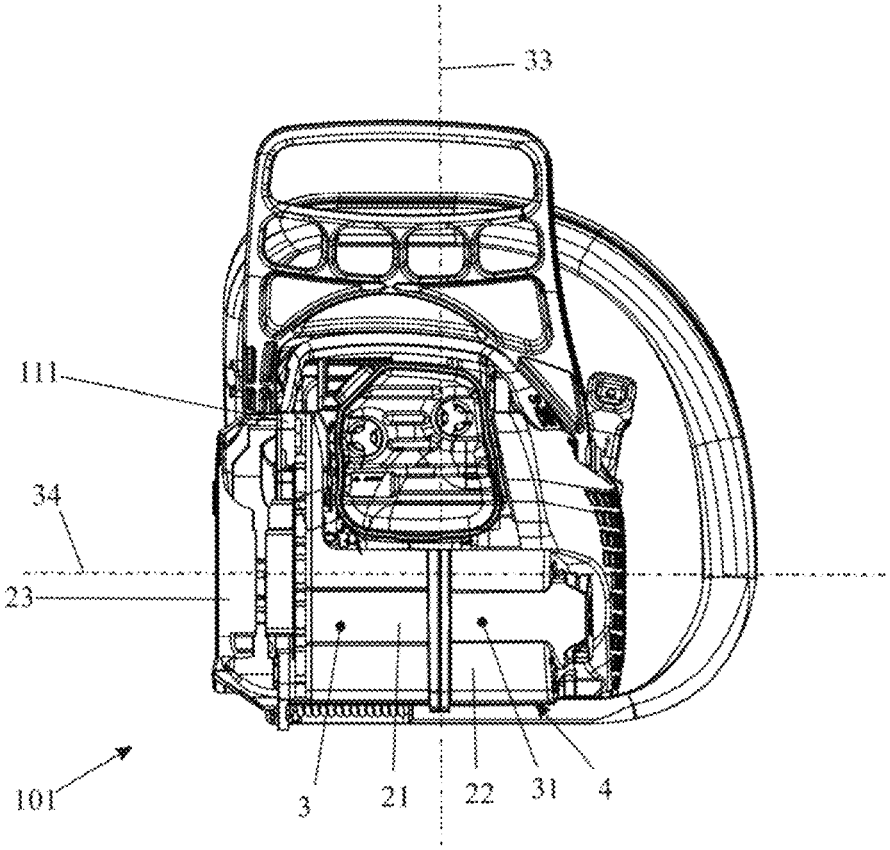
FIG. 7 is a schematic side view of the work apparatus from FIG. 4, perpendicular to the axis of rotation of the drive motor, toward a front side of the work apparatus, in the direction of the arrow VII in FIG. 4.
Figure 8:
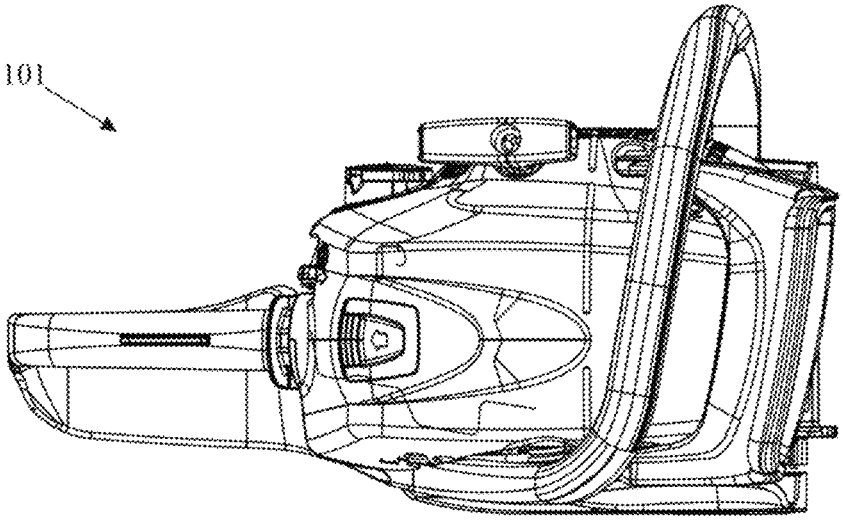
FIG. 8 is a schematic side view of the work apparatus from FIG. 4, perpendicular to the axis of rotation of the drive motor, toward an upper side of the work apparatus, in the direction of the arrow VIII in FIG. 4.
Figure 13:
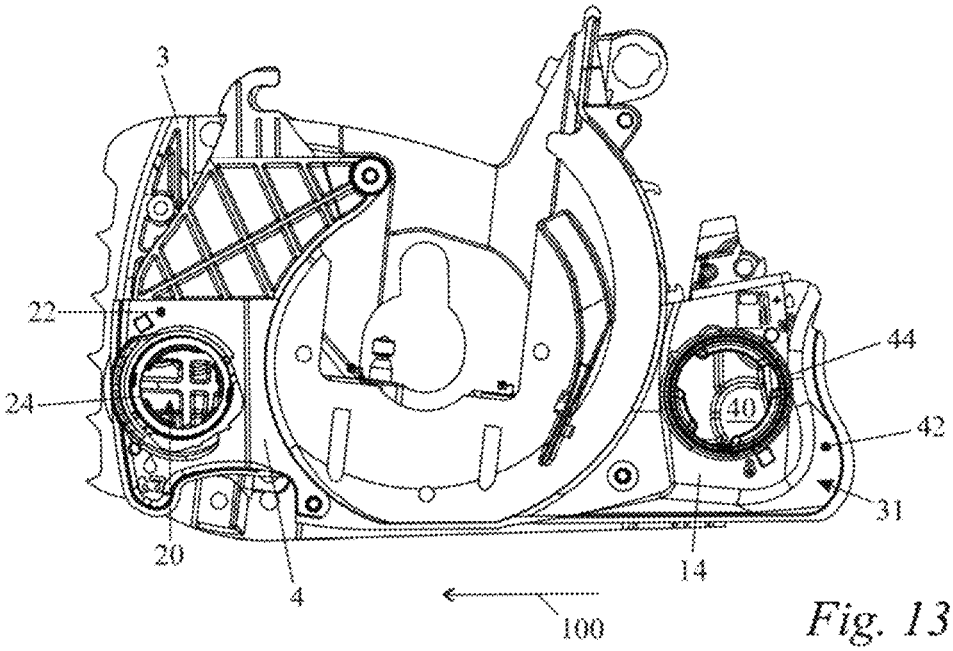
Figure 14:
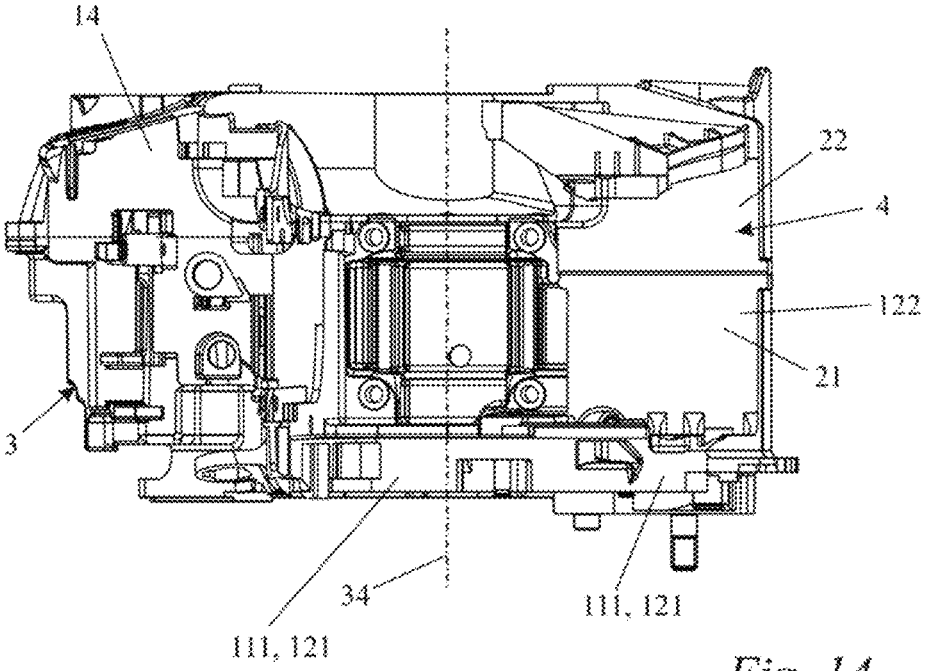
Figure 15:
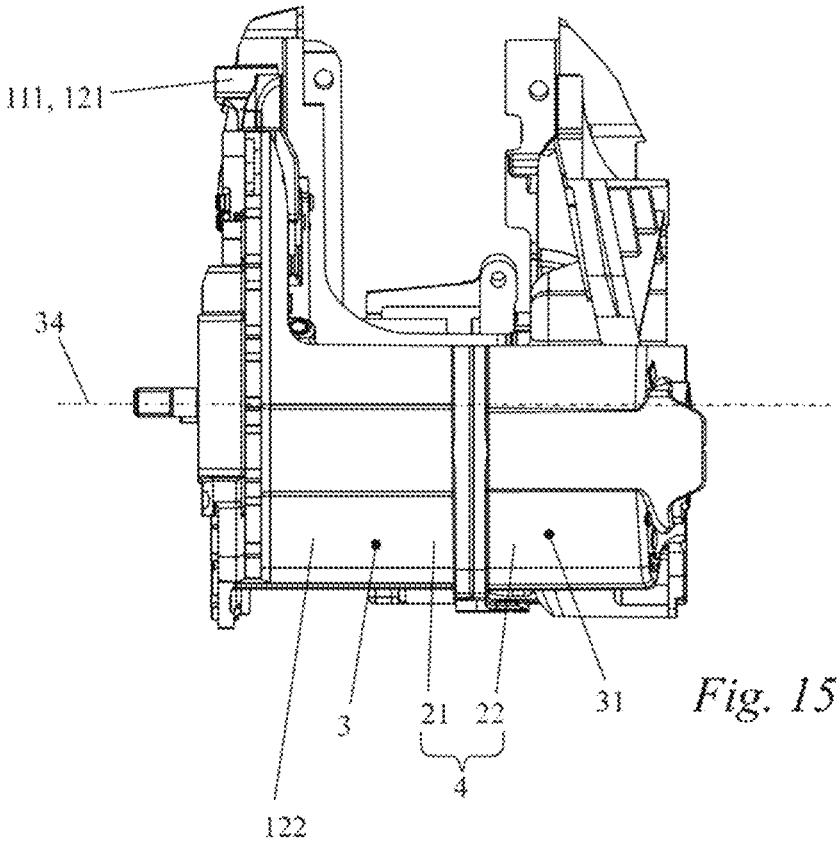
Figure 16:
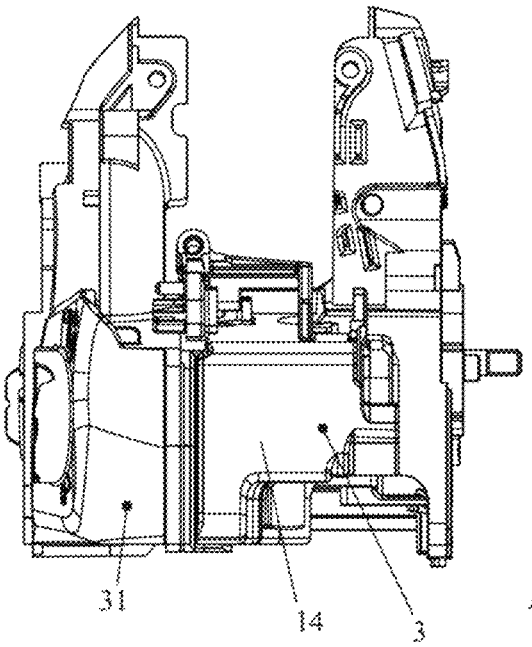

FIG. 13 shows a side view of the central part, composed of the motor carrier 3 and the cover molded part 31, in the direction of the arrow XIII indicated in FIG. 10. The view is thus directed toward the cover molded part 31, parallel to the axis of rotation 34 indicated in FIG. 11. In this view, the positions of the first operating-fluid tank 4 and of the second operating-fluid tank 14 are clearly visible. The first operating-fluid tank 4 is located on the side of the central part that faces away from the handle 9 shown in FIG. 2. The second operating-fluid tank 14 is located on the side of the central part that faces toward the handle 9. When the work apparatus 101 is in the assembled state, the drive motor 2, indicated schematically in FIG. 7, is arranged between the first operating-fluid tank 4 and the second operating-fluid tank 14.

The second housing section 42 of the second operating-fluid tank 14 is formed entirely from light-transmitting material.

In the embodiment according to FIGS. 1 and 3 to 19, the entire cover molded part 31 is made from light-transmitting material. The entire cover molded part 31 is made from the translucent material described. For visible light, the entire cover molded part 31 has the previously described transmission values of between 20% and 50%, measured according to the standard ISO 2471. Since the entire cover molded part 31 is light-transmitting, the cover molded part 31 is easy to produce.

When the handheld work apparatus 101 is in the assembled state, the cover molded part 31, outside of the region of the operating-fluid tank 4, 14, is covered by components of the handheld work apparatus 101, such that, in the non-operating position, light is prevented from entering the cover molded part 31 away from the operating-fluid tank 4, 14. This is represented, for example, in FIG. 9, where the cover molded part 31 outside of the region of the operating-fluid tank 4, 14 is covered by a housing part 32.

Figure 9:
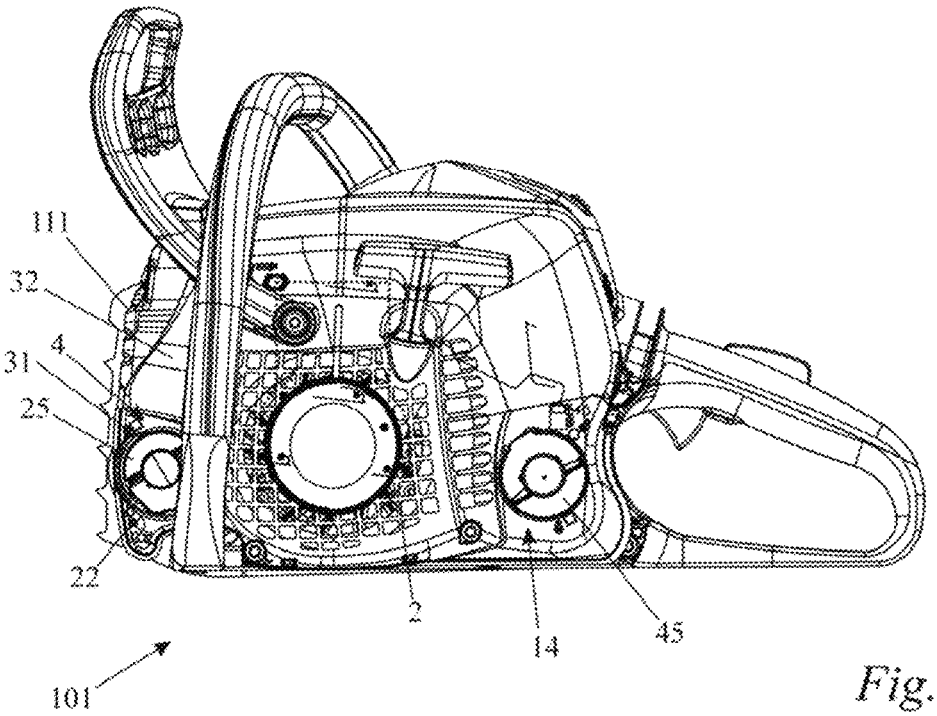
FIG. 9 is a schematic side view of the work apparatus from FIG. 4, in a direction parallel to the axis of rotation of the drive motor, toward a cover molded part of the work apparatus, in the direction of the arrow IX in FIG. 4.

The second housing section 22 of the first operating-fluid tank 4 has a first tank opening 24 of the first operating-fluid tank 4. The first tank opening 24, represented in FIG. 13, affords a view into the interior 20 of the first operating-fluid tank 4. Analogously, the second housing section 42 of the second operating-fluid tank 14 has a second tank opening 44. The interior 40 of the second operating-fluid tank 14 can be seen through the second tank opening 44 in FIG. 4. As represented in FIG. 9, the first tank opening 24 is closed by a first tank cap 25. The second tank opening 44 is closed by a second tank cap 45. It may be provided that the tank cap 25, 45, is realized so as to be light-transmitting and translucent. In the embodiments, however, the tank cap 25, 45 is non-transmitting for visible light.

Figure 18:
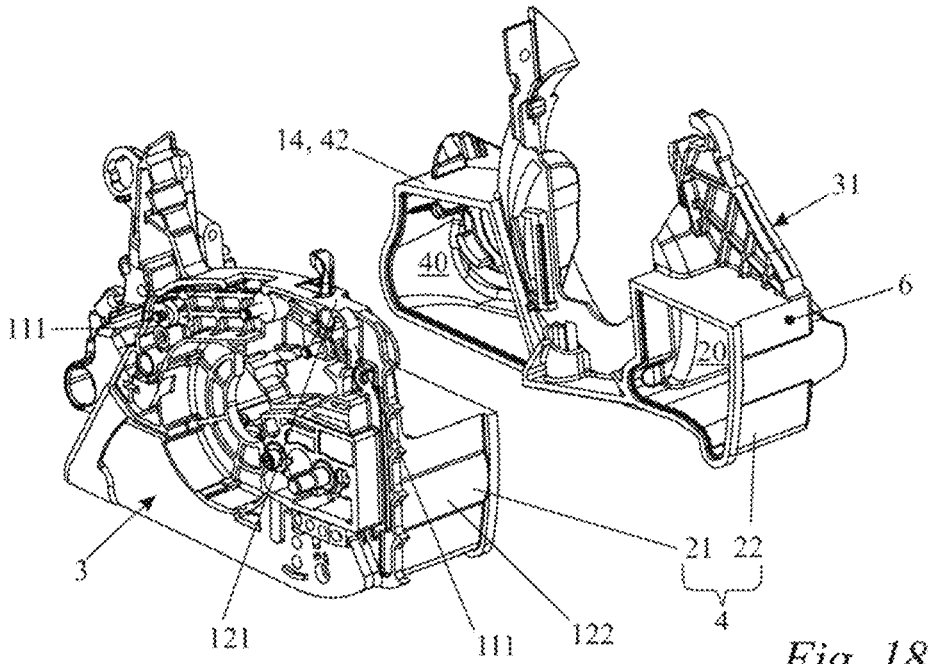
Figure 19:
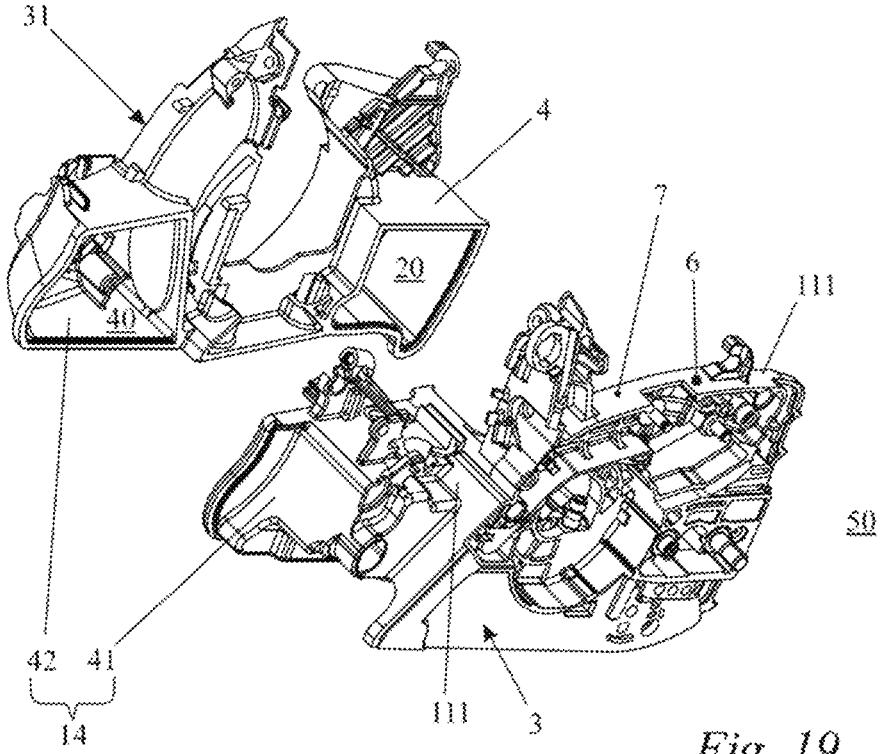

In FIGS. 17 to 19, the motor carrier 3 and the cover molded part 31 of the central part are represented at a distance from each other. It is clear from these FIGS. 17 to 19 that the interior 20 of the first operating-fluid tank 4 is formed both by the motor carrier 3 and by the cover molded part 31. Also the interior 40 of the second operating-fluid tank 14 is formed both by the motor carrier 3 and by the cover molded part 31. For the purpose of forming the first operating-fluid tank 4, both the motor carrier 3 and the cover molded part 31 each have a cavity. Likewise, for the purpose of forming the second operating-fluid tank 14, the motor carrier 3 and the cover molded part 31 each have a cavity. The cavities correspond to each other at a connecting surface. When the motor carrier 3 and the cover molded part 31 are joined together, the interior 20 of the first operating-fluid tank 4 and the interior 40 of the second operating-fluid tank 14 are formed from the mutually corresponding cavities of the motor carrier 3 and of the cover molded part 31.

As represented in FIG. 19, the motor carrier 3 has an outer surface 7. The outer surface is at least partly visible from the outside 50 of the work apparatus 101 represented in FIG. 4. The second light conductive element 111, represented in FIG. 19, extends over at least 5% of the surface 7. In the embodiment according to FIGS. 3 to 19, the second light conductive element 111 extends over at least 20% of the surface 7. It may be provided that the second light conductive element 111 extends over less than 30% of the surface 7 of the motor carrier 3. In the embodiment according to FIGS. 3 to 19, however, this is not the case. The second light conductive element 111 comprises the entire first housing section 21 of the first operating-fluid tank 4. In the embodiment according to FIGS. 3 to 19, the second light conductive element 111 comprises the entire motor carrier 3. In the embodiment, the second light conductive element 111 extends over the entire surface 7 of the motor carrier 3 that is visible from the outside. The second light conductive element 111 is realized in the motor carrier 3.

In the embodiments according to FIGS. 1 to 19, the light conductive elements 11, 111 of the work apparatuses 1, 101 are made of plastic. The light conductive elements 11 and 111 are made of fiber-reinforced plastic. The fiber-reinforced plastic comprises between 30% by weight and 40% by weight fibers, in the embodiment more than 33% by weight and up to and including 35% by weight. In the embodiments, the fiber-reinforced plastic comprises more than 33% by weight fibers. In the embodiments, the fibers are glass fibers. Owing to the use of a plastic having between 30% by weight and 40% by weight glass fibers for the light conductive element 11, 111, the light conductive element can be translucent and, at the same time, have the required strength and stiffness. It may also be provided that the light conductive element is made from fiber-free plastic.

Less than 0.1% by weight color pigments are admixed with the plastic of the light conductive element 11, 111. The material of the light conductive element 11, 111 by nature contains the material PA6 GF 35. In the embodiments, the wall thickness of the motor carrier 3 in the region of the light conductive element 11, 111 is less than 2 mm. Optical brighteners are admixed with the material of the light conductive element 11, 111. A special white tone of the material is thereby achieved. The optical brighteners are UV-active optical brighteners.

To improve the resistance of the light conductive element 11, 111 to UV light, stabilizers are added to the granulate from which the plastic for the light conductive element 11, 111 is produced. This reduces the risk of discoloration of the light conductive element 11, 111 by the action of UV light.

In the embodiments, the cover molded part 31 is produced from the same material as the light conductive element 11, 111. As a result, a good translucence, having the sought transmission values, is also achieved for the second housing section 22 of the first operating-fluid tank 4 and for the second housing section 42 of the second operating-fluid tank 14. Owing to the use of brighteners for the material of the cover molded part 31, the contrast effect, between the operating fluid 5, 15 present in the operating-fluid tank 4, 14 and the second housing section 22, 42, is increased. As a result, the fill level of the operating-fluid tank 4, 14 is more clearly discernible.

The advantages and features pointed out in connection with one embodiment may also be applied to other embodiments, or combined with features and advantages of other embodiments.

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:
a drive motor;
a motor carrier for accommodating and holding said drive motor thereon;
an operating-fluid tank having a first housing section and a second housing section;
the first housing section being integrally formed with said motor carrier so as to be a unitary part therewith;
said second housing section having a portion thereof made of light-transmitting material to permit discerning the fill level of said operating-fluid tank;
said motor carrier including a light-transmitting light-conducting element for conducting light into said operating-fluid tank; and,
wherein said light-conducting element includes all of said first housing section of said operating-fluid tank.

2. The handheld work apparatus of claim 1, wherein said first housing section is at least partially covered by an opaque element of said work apparatus.

3. The handheld work apparatus of claim 1, wherein said second housing section is made completely of light-transmitting material.

4. The handheld work apparatus of claim 1, wherein said light-conducting element is translucent.

5. The handheld work apparatus of claim 1, wherein said light-conducting element is made of plastic.

6. The handheld work apparatus of claim 5, wherein said light-conducting element is made of fiber-reinforced plastic, wherein the plastic includes between 30% by weight and 40% by weight fibers.

7. The handheld work apparatus of claim 5, wherein less than 0.1% by weight color pigments are admixed with said plastic.

8. The handheld work apparatus of claim 1, wherein said motor carrier has an exterior wall; and, said light-conducting element is part of said exterior wall of said motor carrier.

9. The handheld work apparatus of claim 8, wherein:
said exterior wall has a wall thickness (d); and,
said light-conducting element extends at least over a portion of said wall thickness (d) of said exterior wall of said motor carrier.

10. The handheld work apparatus of claim 8, wherein:
said exterior wall has a wall thickness (d); and,
said light-conducting element extends over all of said wall thickness (d) of said exterior wall of said motor carrier.

11. The handheld work apparatus of claim 1, wherein said motor carrier has an outer surface; and, said light-conducting element extends over at least 5% of said outer surface.

12. The handheld work apparatus of claim 1, wherein said motor carrier has an outer surface; and, said light-conducting element extends over at least 20% of said outer surface.

13. The handheld work apparatus of claim 1, wherein said light-conducting element includes all of said motor carrier.

14. The handheld work apparatus of claim 1, wherein said operating-fluid tank is an oil tank.

15. A handheld work apparatus comprising:
a drive motor;
a motor carrier for accommodating and holding said drive motor thereon;
an operating-fluid tank having a first housing section and a second housing section;
the first housing section being integrally formed with said motor carrier so as to be a unitary part therewith;
said second housing section having a portion thereof made of light-transmitting material to permit discerning the fill level of said operating-fluid tank;
said motor carrier including a light-transmitting light-conducting element for conducting light into said operating-fluid tank; and,
wherein said operating-fluid tank is a fuel tank.

16. The handheld work apparatus of claim 1, wherein said work apparatus is a motor-driven chainsaw; said operating-fluid tank is a first operating-fluid tank; said work apparatus includes a second operating-fluid tank; said first operating-fluid tank is an oil tank; and, said second operating-fluid tank is a fuel tank.

17. The handheld work apparatus of claim 16, further comprising:
a further light-conducting element assigned to said second operating-fluid tank; and,
said light-conducting element of said first operating-fluid tank and said light-conducting element of said second fuel tank being formed as a single component.

18. A handheld work apparatus comprising:
a drive motor;
a motor carrier for accommodating and holding said drive motor thereon;
an operating-fluid tank having a first housing section and a second housing section;
the first housing section being integrally formed with said motor carrier so as to be a unitary part therewith;
said second housing section having a portion thereof made of light-transmitting material to permit discerning the fill level of said operating-fluid tank;
said motor carrier including a light-transmitting light-conducting element for conducting light into said operating-fluid tank; and,
wherein said handheld work apparatus has a work tool; and; said motor carrier is configured to carry said work tool.

* * * * *